US008727808B2

(12) United States Patent
Mason et al.

(10) Patent No.: US 8,727,808 B2
(45) Date of Patent: May 20, 2014

(54) ELECTRICAL CONNECTOR ASSEMBLY FOR INTERCONNECTING AN ELECTRONIC MODULE AND AN ELECTRICAL COMPONENT

(75) Inventors: Jeffery W. Mason, North Attleboro, MA (US); Takeshi Nakashima, Kawasaki (JP); Junya Mizushima, Kawasaki (JP)

(73) Assignees: Tyco Electronics Corporation, Berwyn, PA (US); Tyco Electronics Japan G.K. (JP)

( * ) Notice: Subject to any disclaimer, the term of this patent is extended or adjusted under 35 U.S.C. 154(b) by 56 days.

(21) Appl. No.: 13/475,303

(22) Filed: May 18, 2012

(65) Prior Publication Data

US 2013/0017721 A1 Jan. 17, 2013

Related U.S. Application Data

(60) Provisional application No. 61/507,400, filed on Jul. 13, 2011, provisional application No. 61/555,586, filed on Nov. 4, 2011.

(51) Int. Cl.
*H01R 13/648* (2006.01)

(52) U.S. Cl.
USPC ..... 439/607.05

(58) Field of Classification Search
USPC ..... 439/607.1, 607.05, 607.09, 607.14, 92, 439/108; 29/884
See application file for complete search history.

(56) References Cited

U.S. PATENT DOCUMENTS 3,246,208 A * 4/1966 Ross et al. ..... 361/805
3,587,028 A * 6/1971 Uberbacher ..... 439/49
4,611,867 A * 9/1986 Ichimura et al. ..... 439/101
5,201,855 A * 4/1993 Ikola ..... 439/607.14
6,400,577 B1 6/2002 Goodwin et al.
6,442,045 B1 8/2002 Goodwin et al.
6,471,525 B1 10/2002 Fan et al.
6,686,649 B1 2/2004 Mathews et al.
6,877,223 B2 * 4/2005 Figueroa et al. ..... 29/884
6,891,266 B2 5/2005 Kinayman et al.
6,903,541 B2 6/2005 Ziegner et al.
6,971,916 B2 * 12/2005 Tokunaga ..... 439/607.09
7,049,682 B1 5/2006 Mathews et al.
7,063,569 B2 6/2006 Figueroa et al.
7,170,169 B2 1/2007 Trout et al.
7,553,187 B2 * 6/2009 Feldman et al. ..... 439/607.17
7,622,793 B2 11/2009 Anderson
7,726,976 B2 6/2010 Mason et al.
7,748,989 B2 * 7/2010 Kazama et al. ..... 439/66
7,927,144 B2 * 4/2011 Feldman et al. ..... 439/607.05
8,025,531 B1 * 9/2011 Zhang et al. ..... 439/607.05
2002/0192994 A1 12/2002 Turner et al.
2005/0079744 A1 4/2005 Novotny et al.
2007/0259540 A1 11/2007 Taylor

* cited by examiner

*Primary Examiner* — Alexander Gilman

(57) ABSTRACT

An electrical connector assembly including an interposer having a side surface and an array of electrical contacts exposed along the side surface. The electrical contacts are located within a contact region that extends along the side surface. The electrical contacts are configured to engage an electronic module mounted over the contact region. The connector assembly also includes a shield wall that is attached to and extends along the side surface. The shield wall separates the contact region into shielded sub-regions. The shield wall includes a conductive material and is electrically coupled to the interposer. At least one electrical contact is located within each shielded sub-region. The shield wall extends between adjacent electrical contacts to shield the adjacent electrical contacts from electromagnetic interference.

20 Claims, 10 Drawing Sheets

ELECTRICAL CONNECTOR ASSEMBLY FOR INTERCONNECTING AN ELECTRONIC MODULE AND AN ELECTRICAL COMPONENT

CROSS-REFERENCE TO RELATED APPLICATIONS

The present application claims the benefit of U.S. Provisional Patent Application No. 61/507,400, filed on Jul. 13, 2011, and of U.S. Provisional Patent Application No. 61/555,586, filed on Nov. 4, 2011. Each of the above applications is incorporated by reference in its entirety.

BACKGROUND OF THE INVENTION

The subject matter described and/or illustrated herein relates generally to electrical connector assemblies for electronic modules.

Competition and market demands have continued the trend toward smaller and higher performance (e.g., faster) electrical systems and devices. The desire for higher density electrical systems and devices has led to the development of surface mount technology. In surface mount technology, an electronic module is mounted onto a surface of an electrical component, such as a printed circuit board. The electrical component typically has exposed pads or electrical contacts on the surface that electrically connect with the electronic module. Examples of surface-mount connector assemblies include land-grid array (LGA) assemblies and ball-grid array (BGA) assemblies. In some cases, the connector assemblies include an interposer located between the electronic module and the electrical component. The interposer communicatively couples the electronic module and the electrical component.

During operation of the connector assemblies, current transmitted through signal contacts may cause electromagnetic interference (EMI) that negatively effects the overall electrical performance. To control or reduce the effects of EMI, the electrical contacts may include ground contacts among the signal contacts. The ground contacts are positioned within the array such that individual or differential pairs of the signal contacts are surrounded by ground contacts thereby shielding the signal contacts. However, to provide adequate shielding between neighboring signal contacts or signal contact pairs, each signal contact or signal contact pair is typically surrounded by a plurality of ground contacts such that a ground contact is disposed between the signal contact or signal contact pair and each neighboring signal contact or signal contact pair. Consequently, the ground contacts occupy space within the array that could otherwise be occupied by signal contacts.

Accordingly, there is a need for other methods of shielding the signal contacts within an electrical connector assembly.

BRIEF DESCRIPTION OF THE INVENTION

In one embodiment, an electrical connector assembly is provided that includes an interposer having a side surface and an array of electrical contacts exposed along the side surface. The electrical contacts are located within a contact region that extends along the side surface. The electrical contacts are configured to engage an electronic module mounted over the contact region. The connector assembly also includes a shield wall that is attached to and extends along the side surface. The shield wall separates the contact region into shielded sub-regions. The shield wall includes a conductive material and is electrically coupled to the interposer. At least one electrical contact is located within each shielded sub-region. The shield wall extends between adjacent electrical contacts to shield the adjacent electrical contacts from electromagnetic interference.

In another embodiment, an electrical connector assembly is provided that includes an interposer having a side surface and an array of electrical contacts exposed along the side surface. The electrical contacts are located within a contact region that extends along the side surface. The electrical contacts are configured to engage an electronic module mounted over the contact region. The connector assembly also includes a shielding matrix having a plurality of shield walls that extend along the side surface and separate the contact region into shielded sub-regions. The shield walls include a conductive material and are electrically coupled to the interposer. At least one electrical contact is located within each shielded sub-region. The shield walls extend between adjacent electrical contacts to shield the respective adjacent electrical contacts from electromagnetic interference.

DETAILED DESCRIPTION OF THE INVENTION

Embodiments described herein include electrical connector assemblies that include interposers having a base substrate and an array of electrical contacts coupled thereto. The interposer has a side surface in which one or more shield walls of the connector assembly extend therealong between adjacent electrical contacts. For example, the shield wall may be upright extending orthogonal or perpendicular to the side surface. An electronic module is configured to be mounted over the connector assembly onto the shield wall(s). Various embodiments described herein include one or more ground pathways that exist through the shield wall and extend to the interposer. In some embodiments, the ground pathway extends from the electronic module through the shield wall and to the interposer. In other embodiments, the ground pathway extends from an electrical contact exposed along the side surface, through the shield wall, and to the interposer. In some embodiments, the shield wall is electrically coupled to the interposer at a thru-hole(s). In other embodiments, the shield wall may have a projection that extends through the base substrate to electrical contacts on the other side of the base substrate where the projection is electrically coupled. Various embodiments described herein may include a plurality of the shield walls that form a shielding matrix.

Figure 1:
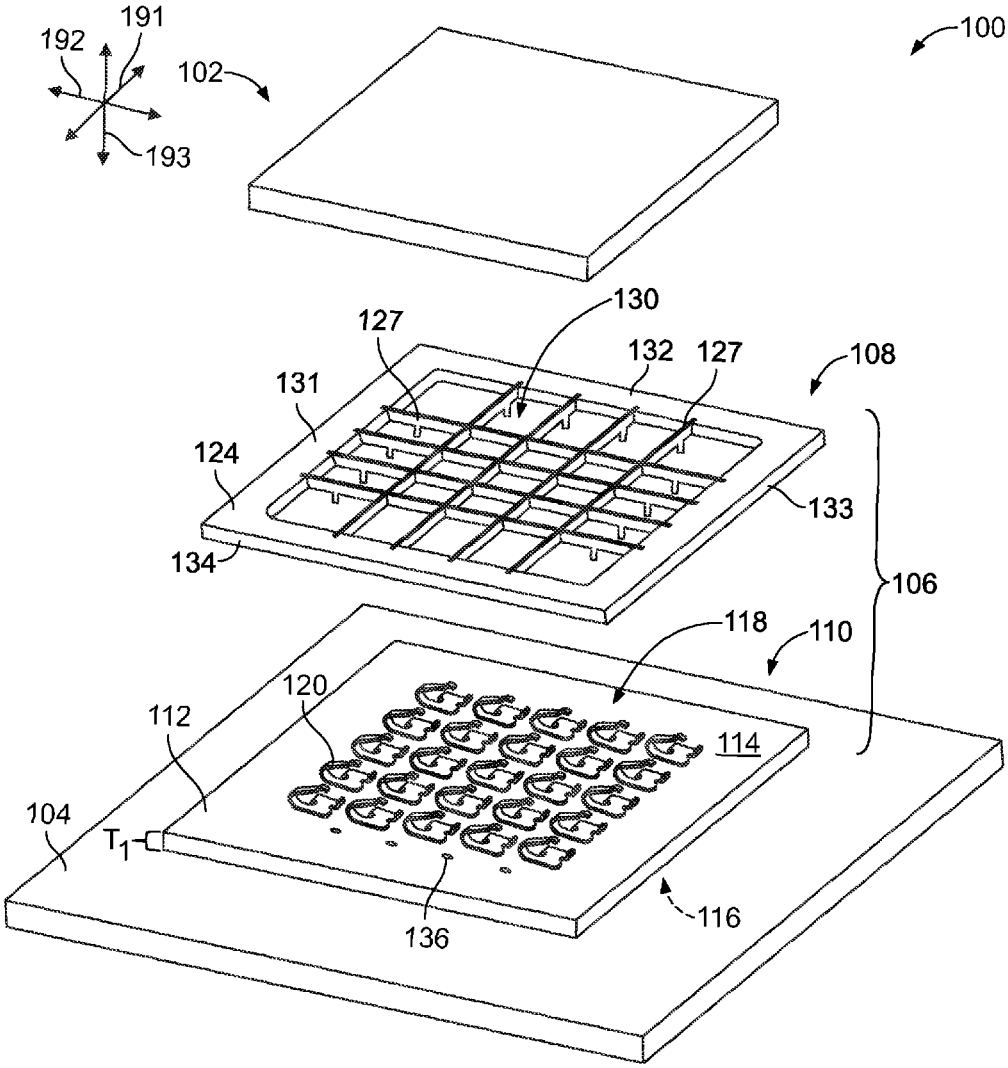
FIG. 1 is an exploded perspective view of an electrical system that includes an electrical connector assembly formed in accordance with one embodiment.

FIG. 1 is an exploded perspective view of an electrical system 100 that includes an electrical connector assembly 106 formed in accordance with one embodiment. The system 100 includes an electronic module 102, an electrical component 104, and the connector assembly 106 located therebetween, which interconnects the electronic module 102 and the electrical component 104. The connector assembly 106 includes a shielded frame assembly 108 and an interposer 110 that are stacked with respect to each other. The connector assembly 106 is positioned between the electronic module 102 and the electrical component 104 and configured to transmit current (e.g., in the form of data signals) through a plurality of conductive pathways. As shown in FIG. 1, the system 100 is oriented with respect to mutually perpendicular axes 191-193 that include lateral axes 191 and 192 and a stacking axis 193.

In some embodiments, the electronic module 102 receives input data signals, processes the input data signals, and provides output data signals. The electronic module 102 may be any one of various types of modules, such as a chip, a package, a central processing unit (CPU), a processor, a memory, a microprocessor, an integrated circuit, a printed circuit, an application specific integrated circuit (ASIC), an electrical connector, and/or the like. In an exemplary embodiment, the electrical component 104 is a printed circuit board (PCB), but may be other electrical components capable of communicating with the electronic module 102 through the connector assembly 106. Although not shown, the system 100 may also include a heat sink. The heat sink may be mounted to the electronic module 102 and/or portions of the connector assembly 106 to facilitate dissipating thermal energy from the system 100.

The interposer 110 has side surfaces 114 and 116 that face in opposite directions along the stacking axis 193. The interposer 110 includes a base substrate 112 having a thickness $T_1$ that is defined between the side surfaces 114 and 116. The side surface 114 is configured to have the shielded frame assembly 108 mounted thereon. The base substrate 112 may be fabricated in a similar manner as PCBs. For instance, the base substrate 112 may include a plurality of stacked layers of dielectric material and may also include conductive pathways through the stacked layers that are formed from vias, plated thru-holes, conductive traces, and the like. The base substrate 112 may be fabricated from and/or include any material(s), such as, but not limited to, ceramic, epoxy-glass, polyimide (e.g., Kapton® and the like), organic material, plastic, and polymer. Also shown in FIG. 1, the base substrate 112 includes shielding holes 136. The shielding holes 136 extend a depth into the base substrate 112. The shielding holes 136 may extend partially or completely through the thickness $T_1$.

The interposer 110 also includes an array 118 of electrical contacts 120 that are exposed along the side surface 114. In the illustrated embodiment, the array 118 includes rows and columns of aligned electrical contacts 120. However, in other embodiments, the electrical contacts 120 may be located in different desired arrangements. In particular embodiments, the electrical contacts 120 may be separate and distinct components with respect to the base substrate 112. For example, in an exemplary embodiment, the electrical contacts 120 are stamped and formed from sheet material and are mechanically and electrically coupled to the base substrate 112. Although not shown, the electrical contacts 120 have contact tails that are inserted into corresponding plated thru-holes of the base substrate 112.

In other embodiments, the electrical contacts 120 are separate and distinct components with respect to the base substrate 112 that are mechanically and electrically coupled to the base substrate 112 by other means. For example, the electrical contacts 120 may be soldered to contact pads along the side surface 114. The electrical contacts 120 can also be fabricated with the base substrate 112. For example, the electrical contacts 120 may be contact pads. In such embodiments, the mating contacts of the electronic module 102 may be particularly configured to engage the respective electrical contacts of the interposer 110.

As shown in FIG. 1, the shielded frame assembly 108 includes a socket frame 124 and a plurality of shield walls 127. The socket frame 124 includes a plurality of frame walls 131-134 that are coupled to one another. The frame walls 131-134 are configured to surround and define a contact or reception region 128 (referenced in FIG. 3) of the shielded frame assembly 108 where electrical contacts are positioned in the connector assembly 106. The shield walls 127 are configured to extend through the contact region 128. In particular embodiments, the shield walls 127 are arranged to form a shielding matrix 130. The shield walls 127 can intersect each other. As will be described in greater detail below, the shield walls 127 and the shielding matrix 130 are configured to control or reduce electromagnetic interference (EMI) that occurs during operation of the system 100.

In the illustrated embodiment, the connector assembly 106 may constitute an area grid assembly, such as a land grid array (LGA) assembly or a ball grid array (BGA) assembly. However, it is to be understood that the subject matter described and/or illustrated herein is not limited to the number or type of parts shown in the Figures, but may include and/or operate in conjunction with additional parts, components, and/or the like that are not shown or described herein. Thus, the following description and the drawings are provided for purposes of illustration, rather than limitation, and show only certain applications of the subject matter described and/or illustrated herein.

Figure 2:
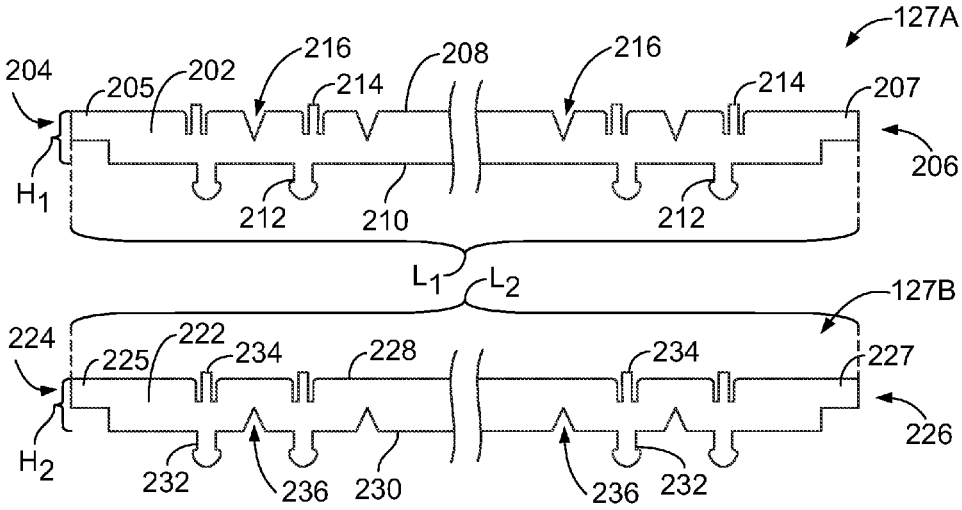
FIG. 2 is a plan view of shield walls that may be used with the connector assembly of FIG. 1.

FIG. 2 is a side view of a first shield wall 127A and a second shield wall 127B that may be used in the shielded frame assembly 108 (FIG. 1). The first shield wall 127A includes a wall body 202 that extends between wall ends 204, 206. The first shield wall 127A extends a length $L_1$ between the wall ends 204, 206. The wall body 202 has a substantially panel-like or sheet-like structure with opposite side surfaces that extend substantially parallel to each other with a thickness $T_2$ (FIG. 4) of the wall body 202 being defined therebetween. The wall body 202 has a module edge 208 and a component edge 210 that extend between the wall ends 204, 206 and substantially parallel to each other. The first shield wall 127A extends a height $H_1$ between the module and component edges 208, 210. The module edge 208 is configured to interface with the electronic module 102 (FIG. 1). The component edge 210 is configured to interface with the electrical component 104 (FIG. 1).

The second shield wall 127B includes a wall body 222 that extends between wall ends 224, 226. The wall body 222 has a substantially panel-like or sheet-like structure with opposite side surfaces that extend substantially parallel to each other with a thickness $T_3$ (FIG. 4) of the wall body 222 being defined therebetween. The thicknesses $T_2$ and $T_3$ may be, for example, less than about 5 mils or, more specifically, less than about 2 mils or 1 mil. The wall body 222 has a module edge 228 and a component edge 230 that extend between the wall ends 224, 226 substantially parallel to each other. The second shield wall 127B extends a height $H_2$ between the module and component edges 228, 230. The module edge 228 is configured to interface with the electronic module 102. The component edge 230 is configured to interface with the electrical component 104.

The shield walls 127A, 127B include various features that facilitate controlling the effects of EMI during operation of the system 100 (FIG. 1) and/or forming the shielding matrix 130 (FIG. 1). For example, the first shield wall 127A includes respective tabs 205, 207 at the wall ends 204, 206, respectively. The tabs 205, 207 are configured to engage the socket frame 124 (FIG. 1). The first shield wall 127A also includes a plurality of mounting projections 212 that project from the component edge 210. In the illustrated embodiment, the mounting projections 212 may be tails or pins. The mounting projections 212 are configured to be inserted into the shielding holes 136 (FIG. 1) to mechanically and electrically engage the first shield wall 127A and the base substrate 112 (FIG. 1).

The first shield wall 127A may also have a plurality of grounding features 214 that are configured to engage the electronic module 102. In an exemplary embodiment, the grounding features 214 are beams that project away from or clear the module edge 208. The grounding features 214 may have a curved contour that permits some flexion when the electronic module 102 engages the grounding features 214. In particular embodiments, the grounding features 214 are substantially proximate to one of the mounting projections 212 so that a ground pathway extends therebetween. Also shown, the first shield wall 127A has a plurality of crossover features 216 along the module edge 208. In an exemplary embodiment, the crossover features 216 are V-shaped slits or notches in the module edge 208.

The second shield wall 127B includes respective tabs 225, 227 that are configured to engage the socket frame 124. The second shield wall 127B also includes a plurality of mounting projections 232 that project from the component edge 230. The mounting projections 232 are configured to be inserted into the shielding holes 136 of the base substrate 112 to mechanically and electrically engage the second shield wall 127B and the base substrate 112. In addition, the second shield wall 127B has a plurality of grounding features 234 that are configured to engage the electronic module 102. Similar to the grounding features 214, the grounding features 234 may include beams that project away from or clear the module edge 228. The grounding features 234 may have a curved contour that permits some flexion when the electronic module 102 engages the grounding features 234. In particular embodiments, the grounding features 234 are substantially proximate to one of the mounting projections 232 so that a ground pathway extends therebetween. Also shown, the second shield wall 127B has a plurality of crossover features 236 along the component edge 230. The crossover features 236 may be V-shaped slits or notches.

In particular embodiments, the shield walls 127A, 127B are stamped from a sheet of conductive material. For example, when the shield walls 127A, 127B are stamped from the sheet of conductive material the shield walls 127A, 127B may include the respective grounding features, crossover features, and the mounting projections. The grounding features may be subsequently (or simultaneously) formed to have the curved contours. In other embodiments, the various features described above may be machined after stamping. The shield walls 127A, 127B may be fabricated in other manners (e.g., die-casting). The shield walls 127A, 127B or the entire shielding matrix 130 can also be molded with a conductive polymer. In such cases, the shielding matrix 130 can be a single continuous structure having the same or similar features as described herein.

FIG. 2 only illustrates portions of the shield walls 127A, 127B. Each of the plurality of grounding features, crossover features, and mounting projections may be distributed along the respective length in any predetermined arrangement. For example, the grounding features may be evenly distributed along the respective length, the crossover features may be evenly distributed along the respective length, and/or the mounting projections may be evenly distributed along the respective length. However, in other embodiments, the features are not evenly distributed but located to achieve a desired effect (e.g., improved electrical performance).

However, it should be understood that the above described shield walls 127A, 127B are only exemplary shield walls. Thus, the shield walls 127A, 12713 may be modified in various manners to achieve desired mechanical and/or electrical effects. For example, although the shield walls 127A, 127B are described as having a plurality of grounding features, a plurality of mounting projections, and a plurality of crossover features, the shield walls 127A, 127B may have only one grounding feature, only one mounting projection, and/or only one crossover feature. Furthermore, the first and second shield walls 127A, 127B may have different numbers of grounding features, crossover features, and mounting projections.

Figure 3:
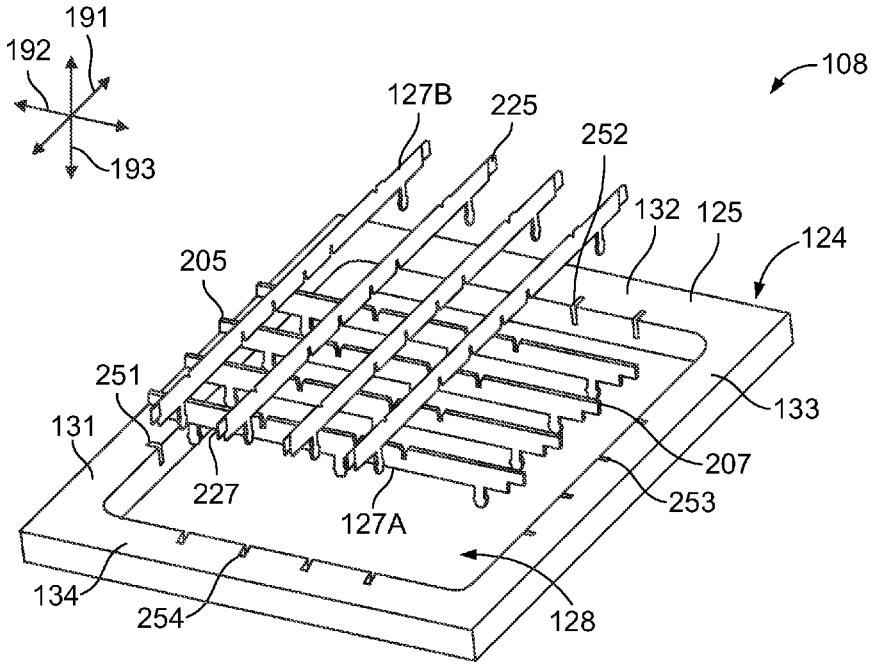
FIG. 3 is an exploded perspective view of a shielded frame assembly that may be used with the connector assembly of FIG. 1.

FIG. 3 is an exploded view of the shielded frame assembly 108. The socket frame 124 has a frame body 125 that includes the frame walls 131-134. The frame body 125 may comprise a unitary structure. For example, in an exemplary embodiment, the frame body 125 is molded from a dielectric material. The frame walls 131, 133 oppose each other across the contact region 128, and the frame walls 132, 134 oppose each other across the contact region 128. In the illustrated embodiment, the frame walls 131-134 include respective wall slots 251-254. The wall slots 251-254 open toward the contact region 128.

To construct the shielded frame assembly 108, the first shield walls 127A are aligned with the corresponding wall slots 251, 253, and the second shield walls 127B are aligned with the corresponding wall slots 252, 254. More specifically, the first shield walls 127A extend parallel to the lateral axis 192 and are spaced apart from one another along the lateral axis 191. The second shield walls 127B extend parallel to the lateral axis 191 and are spaced apart from one another along the lateral axis 192. The tabs 205, 207 are configured to be received by the wall slots 251, 253, respectively, and the tabs 225, 227 are configured to be received by the wall slots 252, 254, respectively.

Figure 4:
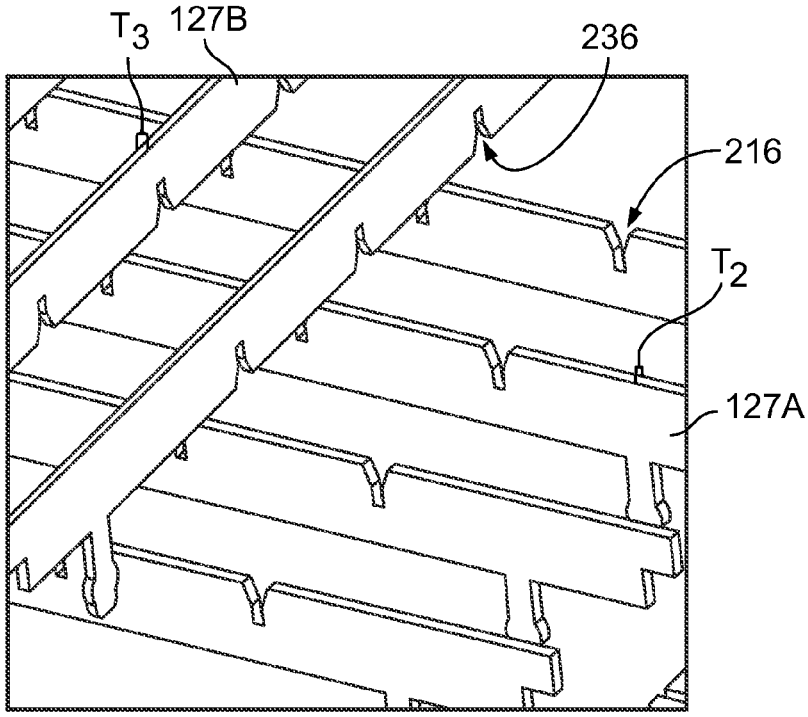
FIG. 4 is an enlarged view of the shielded frame assembly of FIG. 2.

FIG. 4 is an enlarged view of a portion of the exploded shielded frame assembly 108 and shows the shield walls 127A, 127B. As shown, the shield walls 127A, 127B have substantially planar bodies with substantially uniform thicknesses $T_2$ and $T_3$, respectively. When the shield walls 127A, 127B are aligned as shown in FIG. 3, the crossover features 216 of the first shield walls 127A and the crossover features 236 of the second shield walls 1278 are configured to intersect with each other. More specifically, in the illustrated embodiment, each crossover feature 216 receives only one crossover feature 236 from only one of the second shield walls 127B. The crossover features 216, 236 enable the first and second shield walls 127A, 127B to overlap and mesh with each other while extending in transverse directions. The shield walls 127A, 127B are secured to the socket frame 124 such that the shielded frame assembly 108 is mountable to the interposer 110 as a unit as shown in FIG. 1. To this end, the socket frame 124 and the interposer 110 may have corresponding alignment features that facilitating aligning the shielded frame assembly 108 and the interposer 110.

Figure 5:
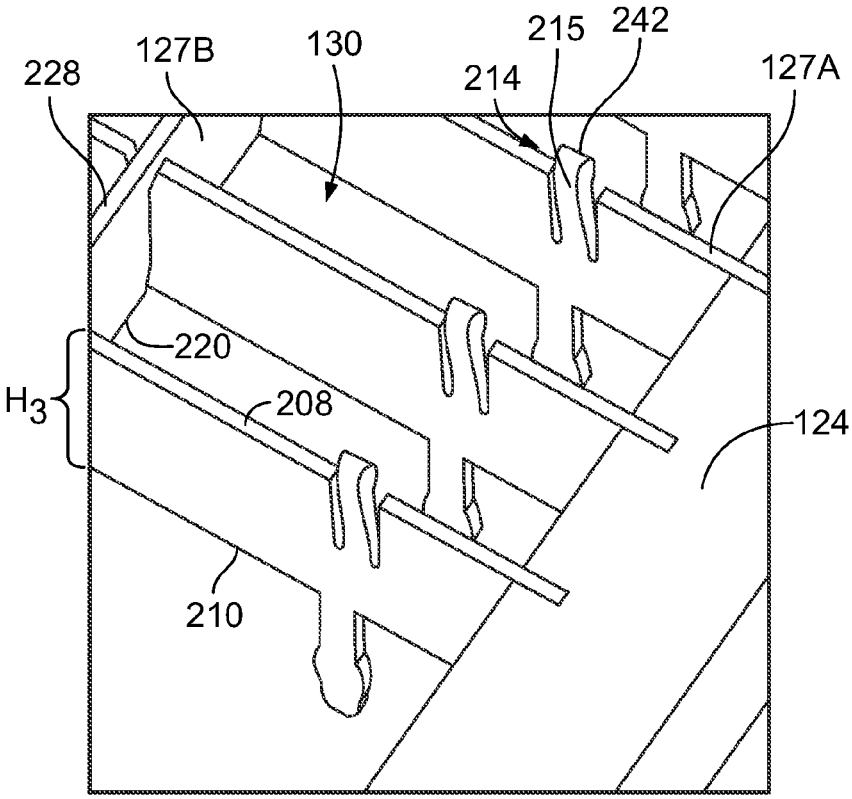
FIG. 5 is an enlarged view of the shielded frame assembly of FIG. 2 when the shielded frame assembly is constructed.

FIG. 5 is an enlarged view of the shielded frame assembly 108 when the shield walls 127A, 127B engage each other and the socket frame 124 to form the shielding matrix 130. As shown, the shielding matrix 130 may have a height $H_3$ that is measured from the lowest component edge, which could be the component edge 210 or 230, and the highest module edge, which could be the module edge 208 or 228. In the illustrated embodiment, the crossover features 216, 236 (FIG. 2) are sized and shaped such that the height $H_3$ is substantially equal to the heights $H_1$, $H_2$ of the shield walls 127A, 127B. In other words, the module edges 208 and 228 may extend along the same plane (i.e., coplanar), and the component edges 210 and 230 may extend along the same plane. Also shown in FIG. 5, the grounding features 214 have curved bodies 215 that extend from the module edge 208 to respective distal ends 242.

Figure 6:
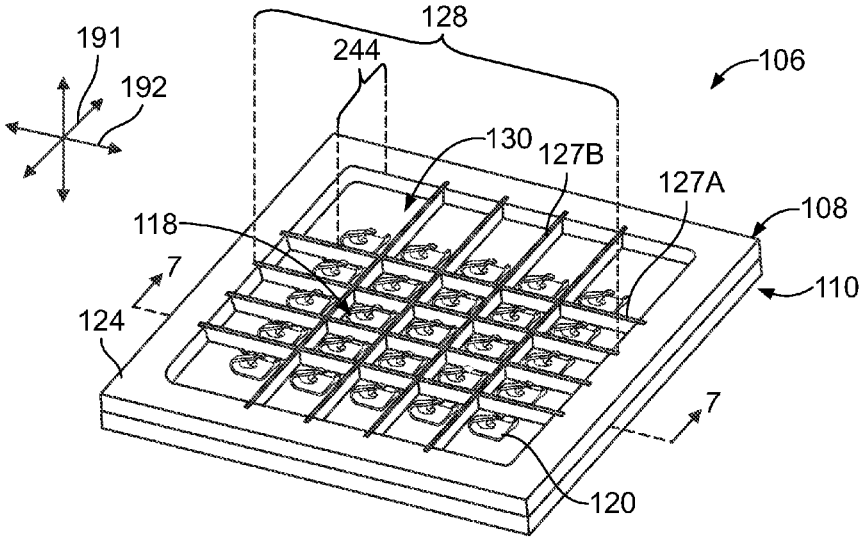
FIG. 6 is a perspective view of the constructed connector assembly of FIG. 1.

FIG. 6 is a perspective view of the constructed connector assembly 106 having the shielded frame assembly 108 coupled to the interposer 110. The contact region 128 is configured to receive the array 118 of electrical contacts 120 and/or the electrical contacts 262 (FIG. 7) of the electronic module 102 (FIG. 1) when the electronic module 102 is mounted onto the shielded frame assembly 108. The shield walls 127A, 127B stand upright with respect to the side surface 114. When the shielding matrix 130 is coupled to the socket frame 124, the shield walls 127A, 127B separate the contact region 128 into a plurality of sub-regions including shielded sub-regions 244. As shown in the constructed connector assembly 106, at least one electrical contact 120 is located within each shielded sub-region 244. More specifically, the shield walls 127A, 12713 extend between adjacent electrical contacts 120 to shield the adjacent electrical contacts 120 from EMI.

In an exemplary embodiment, each of the first shield walls 127A intersects a plurality of second shield walls 127B, and each of the second shield walls 127B intersects a plurality of first shield walls 127A. As shown, the array 118 includes rows and columns of the electrical contacts 120. The first shield walls 127A extend in a linear manner along the lateral axis 192 between adjacent rows of electrical contacts 120, and the second shield walls 12713 extend in a linear manner along the lateral axis 191 between adjacent columns of electrical contacts 120. The shield walls 127A, 127B intersect one another in a perpendicular manner. In other embodiments, the shield walls 127A, 127B may form non-perpendicular angles with respect to one another.

In the illustrated embodiment, the shielded sub-regions 244 include only one electrical contact 120. However, in other embodiments, the shielded sub-regions 244 may include more than one electrical contact 120. For example, the shielded sub-regions 244 could include two electrical contacts 120 that constitute a differential pair, or the shielded sub-regions 244 can include more than two electrical contacts. Furthermore, the shielded sub-regions 244 may include different numbers of electrical contacts 120.

The shielded frame assembly 108 can permit the use of fewer ground contacts in the array 118 as compared to other connector assembles. For example, at least about 60% or at least about 75% of the electrical contacts 120 can be signal contacts that are configured to have data signals transmitted therethrough and the remaining electrical contacts 120 may be ground contacts. In particular embodiments, at least about 90% of the electrical contacts 120 can be signal contacts. In more particular embodiments, essentially all of the electrical contacts 120 can be signal contacts.

In the illustrated embodiment, the shield walls 127A, 127B are linear bodies that extend along only one direction. However, in alternative embodiments, the shield walls 127A, 127B may extend in different directions. For example, the shield walls 127, 127B may be L-shaped with two planar portions that extend perpendicular to each other. In such embodiments, the shield walls 127A, 127B may be stamped and formed to have the L-shape. The shield walls 127A, 127B may also have more than two planar portions. The shield walls 127A, 127B may also have one or more curved portions.

Although the above describes a contact region 128 having numerous shielded sub-regions 244, the connector assembly 106 may have only two shielded sub-regions 244 in other embodiments. For example, a single shield wall 127 may extend across the contact region 128 thereby dividing the contact region 128 into two shielded sub-regions 244. Depending upon where the shield wall 127 divides the contact region 128, the shielded sub-regions 244 may be differently sized as well.

Figure 7:
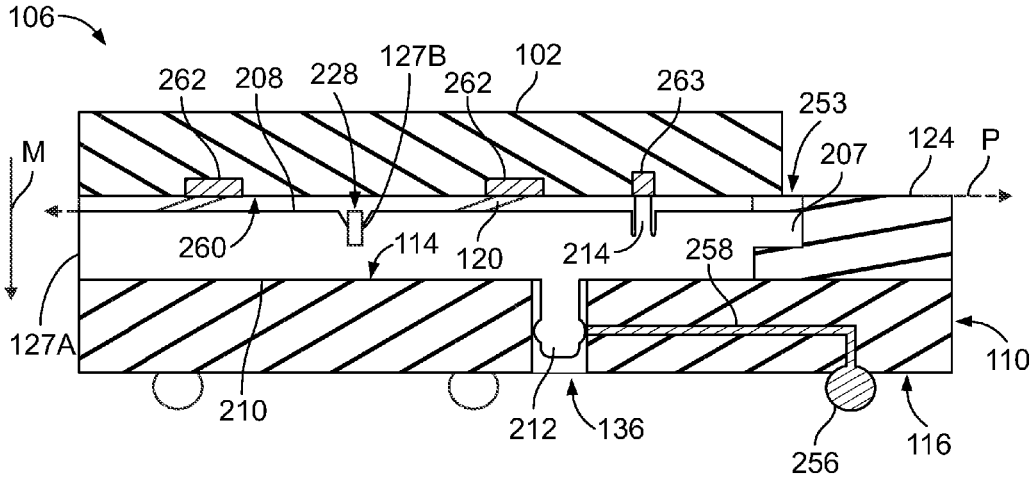
FIG. 7 is a cross-section of the connector assembly taken along the lines 7-7 in FIG. 6 after the connector assembly is mounted onto an interposer.

FIG. 7 is a cross-section of the connector assembly 106 taken along the lines 7-7 in FIG. 6 and having the electronic module 102 mounted thereon. The shield wall 127A is coupled to the socket frame 124 and to the interposer 110. More specifically, the tab 207 is held within the corresponding wall slot 253. The tab 207 may form an interference fit with the wall slot 253. The mounting projection 212 is inserted into the corresponding shielding hole 136. In an exemplary embodiment, the mounting projection 212 forms a mechanical and an electrical coupling with the interposer 110. The shielding hole 136 is electrically connected to an electrical contact 256 of the interposer 110 along the side surface 116. The electrical contact 256 is a solder ball contact, but may be other types of electrical contacts. The shielding hole 136 is a plated thru-hole that is electrically connected to the electrical contact 256 through a conductive trace 258 of the interposer 110. As such, a ground pathway may exist through the shield wall 127A and the interposer 110 during operation of the system 100 (FIG. 1).

As shown, the electrical contacts 120 are configured to project beyond the module edge 208 of the shield wall 127A. When the electronic module 102 is mounted onto the connector assembly 106, the electrical contacts 120 engage electrical contacts 262 of the electronic module 102 and are compressed in a mating direction M that extends along the stacking axis 193 (FIG. 1). The grounding feature 214 engages a corresponding electrical contact 263 of the electronic module 102. The component edge 210 of the shield wall 127A interfaces with the side surface 114, and the module edge 208 interfaces with an underside 260 of the electronic module 102.

In some embodiments, the shield walls 127A, 127B and/or the socket frame 124 are configured to form an interstitial seating plane $P_1$ that is configured to have the electronic module 102 mounted thereon. The seating plane $P_1$ extends parallel to a plane formed by the lateral axes 191, 192 (FIG. 1) and perpendicular to the stacking axis 193. In particular embodiments, the module edges 208, 228 of the shield walls 127A, 127B are configured with respect to each other to form the seating plane $P_1$. For example, the module edges 208, 228 may substantially coincide along the seating plane $P_1$. The seating plane $P_1$ functions as a positive stop that prevents the electrical contacts 120 from being over compressed and/or unevenly compressed. When the electronic module 102 is mounted onto the connector assembly 106, the seating plane $P_1$ prevents further compression along the mating direction M beyond a predetermined point.

Figure 8:
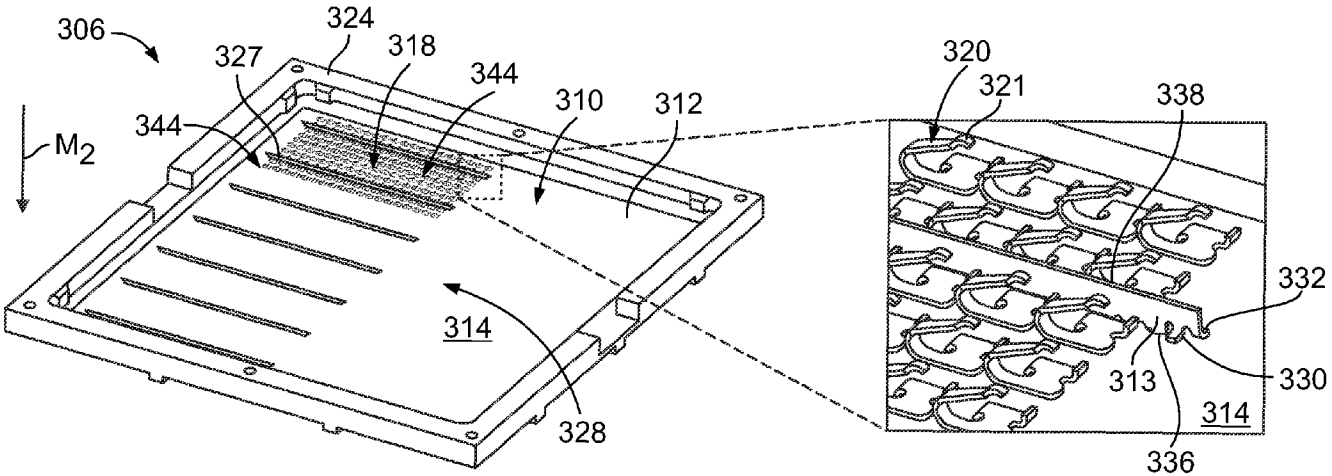
FIG. 8 includes a perspective view of an electrical connector assembly formed in accordance with one embodiment and a detailed view of the connector assembly.

FIG. 8 is a perspective view of an electrical connector assembly 306 formed in accordance with one embodiment. The connector assembly 306 may have similar elements and features as the connector assembly 106 described above and illustrated in FIGS. 1-7. For example, the connector assembly 306 also includes an interposer 310 that has a base substrate 312 and an array 318 of electrical contacts 320 coupled to the base substrate 312. In FIG. 8, only a portion of the array 318 of the electrical contacts 320 has been coupled to the base substrate 312. The electrical contacts 320 project away from a side surface 314 to mating ends 321 of the electrical contacts 320. The connector assembly 306 also includes a socket frame 324 that is coupled to the interposer 310. The socket frame 324 surrounds a contact region 328 that extends along the side surface 314. The electrical contacts 320 are located within the contact region 328 and are configured to engage an electronic module (not shown). The connector assembly 306 also includes shield walls 327 that extend along the base substrate 312 and separate the contact region 328 into shielded sub-regions 344. The shield walls 327 include a conductive material and are electrically coupled to the base substrate 312. Corresponding electrical contacts 320 are located within each shielded sub-region 344. Similar to the shield walls 127 described above, the shield walls 327 facilitate controlling the effects of EMI.

However, unlike the socket frame 124 and the shield walls 127 in FIG. 1, the shield walls 327 are not directly coupled to the socket frame 324. As shown in the detailed portion of FIG. 8, the shield walls 327 include mounting projections 313 and mounting legs 330 and 332 that are configured to engage the base substrate 312. More specifically, the mounting projections 313 may be inserted into shielding holes 336. The mounting legs 330, 332 may be soldered directly to the side surface 314. As such, the shield walls 327 may be secured to the base substrate 312. The shield walls 327 may be secured to the base substrate 312 before, after, or during the installation of the electrical contacts 320.

In an exemplary embodiment, the shield walls 327 are configured to form an interstitial seating plane that is similar to the interstitial seating plane $P_1$. For example, the shield walls 327 may be configured so that the module edges 338 extend along a common plane thereby forming the seating plane. The seating plane functions as a positive stop that prevents the electrical contacts 320 from being over compressed and/or unevenly compressed. When the electronic module is mounted onto the connector assembly 306, the seating plane $P_1$ prevents further compression along a mating direction $M_2$ beyond a predetermined point.

Figure 9:
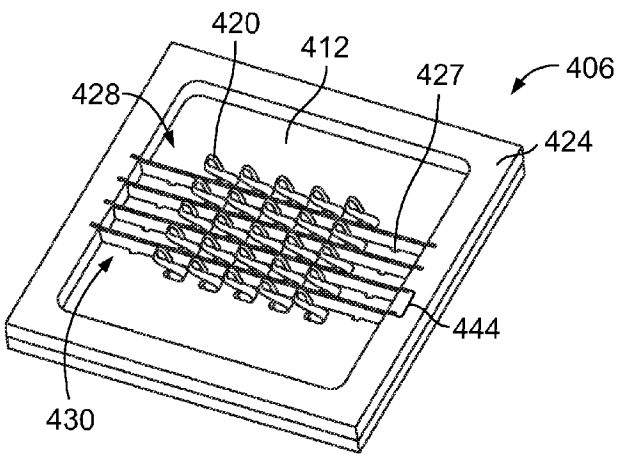
FIG. 9 is a perspective view of an electrical connector assembly formed in accordance with one embodiment.

FIG. 9 is a perspective view of an electrical connector assembly 406 formed in accordance with one embodiment. The connector assembly 406 may have similar elements and features as the connector assemblies 106 and 306 described above and illustrated in FIGS. 1-8. Like the connector assembly 106, the connector assembly 406 has a plurality of shield walls 427 that form a shielding matrix 430 supported by a socket frame 424. The shield walls 427 extend along a base substrate 412 and separate a contact region 428 of the socket frame 424 into shielded sub-regions 444. As shown in FIG. 9, each shielded sub-region 444 includes a single row of electrical contacts 420. There are not any intersecting shield walls 427.

Figure 10:
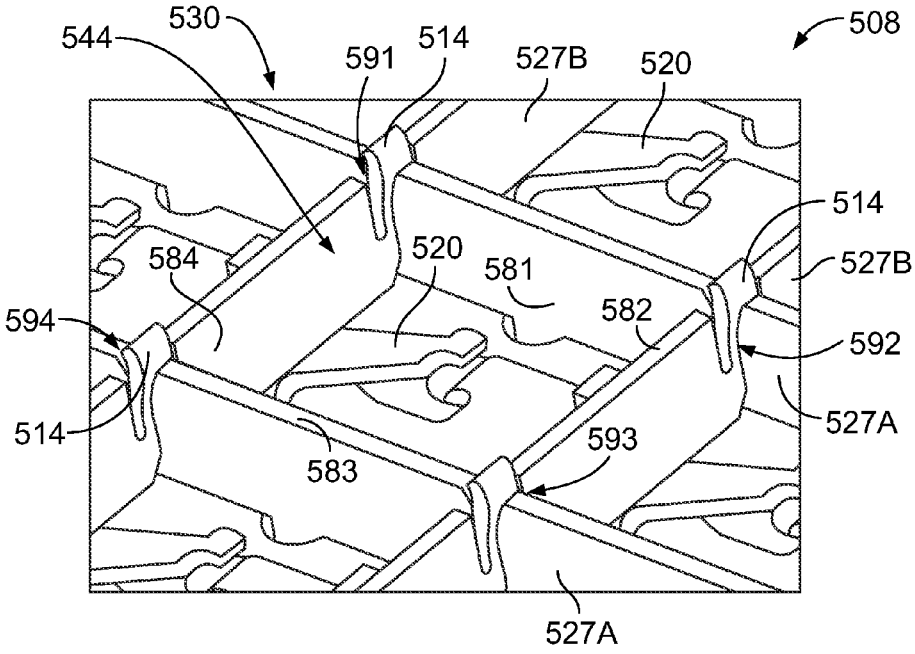
FIG. 10 is an enlarged perspective view of a shielded frame assembly in accordance with one embodiment.
Figure 11:
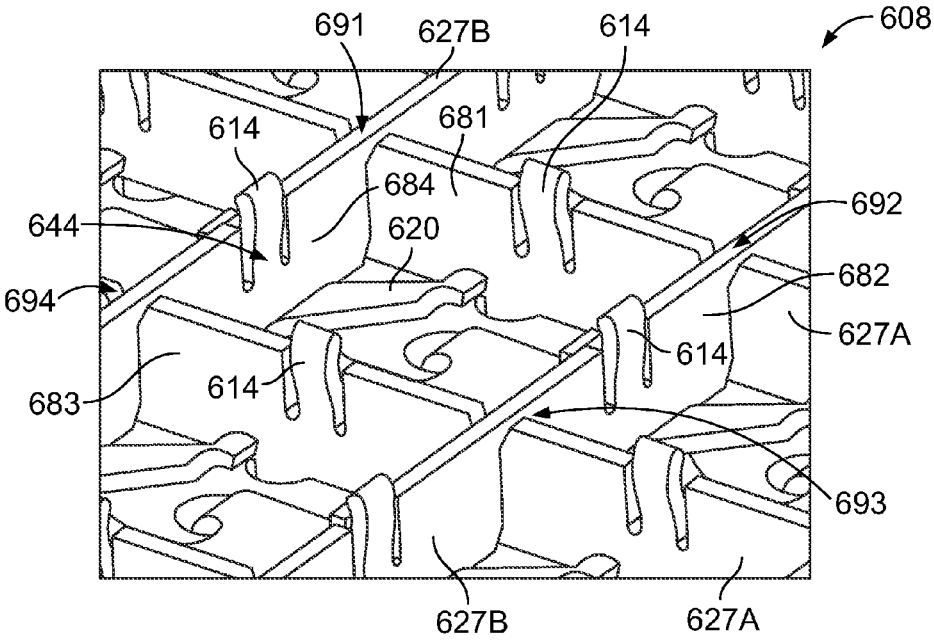
FIG. 11 is an enlarged perspective view of a shielded frame assembly in accordance with one embodiment.

FIGS. 10 and 11 are enlarged views of shielded frame assemblies 508 and 608, respectively. The shielded frame assemblies 508, 608 may be part of an electrical connector assembly, such as the connector assembly 106 (FIG. 1), and may have similar elements and features as the shielded frame assembly 108 (FIG. 1). With respect to FIG. 10, the shielded frame assembly 508 includes shield walls 527A, 527B that engage each other and a socket frame (not shown) that can be similar to the socket frame 124 (FIG. 1). The shield walls 527A, 527B engage each other to form a shielding matrix 530. The shield walls 527A, 527B may be similar to the shield walls 127A, 127B (FIG. 2) and include crossover features (not referenced in FIG. 10) and grounding features 514. Each crossover feature of the shield wall 527A may receive a corresponding crossover feature of the shield wall 527B. Similar to the crossover features 216, 236 in FIG. 2, the crossover features of the shielded frame assembly 508 enable the first and second shield walls 527A, 527B to overlap and mesh with each other while extending in transverse directions. Unlike the shield walls 127A, 127B shown in FIG. 2 in which the grounding features 214, 234 are located between the crossover features 216, 236 along the lengths $L_1$ and $L_2$, the grounding features 514 may be located over corresponding crossover features. In FIG. 10, the grounding features 514 are located over or aligned with the crossover features of the shield walls 527A, 527B.

In an exemplary embodiment, only the shield wall 527B includes the grounding features 514, but in alternative embodiments both of the shield walls 527A, 527B or only the shield wall 527A can include the grounding features 514. In an exemplary embodiment, the shield walls 527A, 527B intersect one another in a perpendicular manner. In other embodiments, the shield walls 527A, 527B may form non-perpendicular angles with respect to one another. When intersected, the shield walls 527A, 527B form a plurality of sub-regions including shielded sub-regions 544. At least one electrical contact 520 can be located within each shielded sub-region 544. The shield walls 527A, 527B extend between adjacent electrical contacts 520 to shield the adjacent electrical contacts 520 from EMI.

Each shielded sub-region 544 can be defined by four wall segments 581-584 of the shield walls 527A, 527B that intersect each other at four intersections 591-594. The intersections 591-594 may include at least one grounding feature 514. For example, in the illustrated embodiment, each intersection 591-594 includes only a single grounding feature 514. However, in alternative embodiments, more than one grounding feature 514 may be used.

FIG. 11 shows another arrangement of grounding features 614 of a shielded sub-region 644. The shielded sub-region 644 is defined by four wall segments 681-684 of shield walls 627A, 627B that intersect each other at four intersections 691-694. In an exemplary embodiment, the grounding features 614 may be located between the intersections 691-694. For example, for each different pair of adjacent intersections, only a single grounding feature 614 is located substantially halfway between adjacent intersections. In other embodiments, more than one grounding feature 614 may be located between adjacent intersections. Further, in other embodiments, the grounding features 614 may be located between adjacent intersections and also at intersections like the grounding features 514 in FIG. 10.

As shown in FIGS. 10 and 11, the shielded sub-regions may include at least one grounding feature 514, 614 for each wall segment that defines the corresponding shielded sub-regions. In other embodiments, a ratio between the number of wall segments to the number of grounding features in a shielded sub-region may be less than one-to-one or more than one-to-one. In the illustrated embodiment, the shielded sub-regions 544, 644 include only one electrical contact 520, 620 but more than one may be used in other embodiments. Similar to the shielded frame assembly 108, the shielded frame assemblies 508, 608 can permit the use of fewer ground contacts as compared to other connector assembles. For example, at least about 60% or at least about 75% of the electrical contacts 520, 620 can be signal contacts that are configured to have data signals transmitted therethrough and the remaining electrical contacts 520, 620 may be ground contacts. In particular embodiments, at least about 90% of the electrical contacts 520, 620 can be signal contacts. In more particular embodiments, essentially all of the electrical contacts 520, 620 can be signal contacts.

Figure 12:
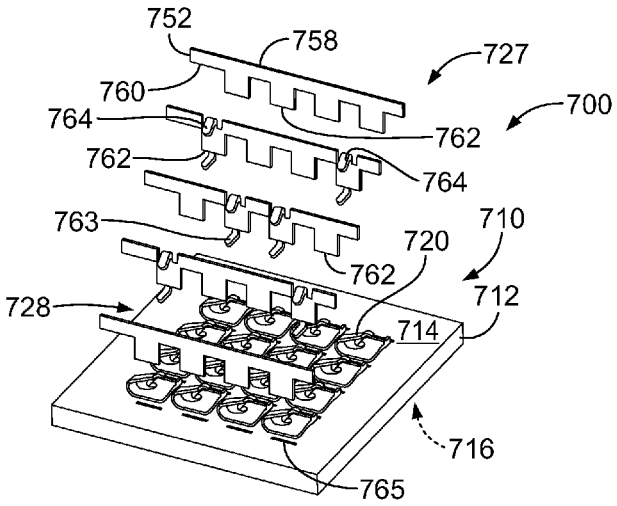
FIG. 12 is a partially exploded view of an electrical connector assembly formed in accordance with one embodiment.
Figure 13:
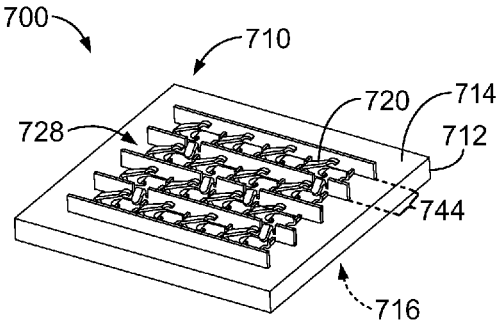
FIG. 13 is a perspective view of the connector assembly of FIG. 12.

FIG. 12 is a partially exploded view of an electrical connector assembly 700 formed in accordance with one embodiment, and FIG. 13 is a perspective view of the constructed connector assembly 700. The connector assembly 700 includes an interposer 710 having a base substrate 712 and an array of electrical contacts 720 coupled thereto. The base substrate 712 includes a first side surface 714 and a second side surface 716 that face in opposite directions. The electrical contacts 720 are exposed along the side surface 714. Although not shown, the connector assembly 700 may include a socket frame coupled to the interposer. The socket frame may be similar to the socket frames 124, 424 described above. A contact region 728 may exist along the side surface 714. The electrical contacts 720 are located within the contact region 728 and are configured to engage an electronic module (not shown) mounted over the contact region 728. The electronic module may be similar to the electronic module 102 (FIG. 1).

Figure 14:
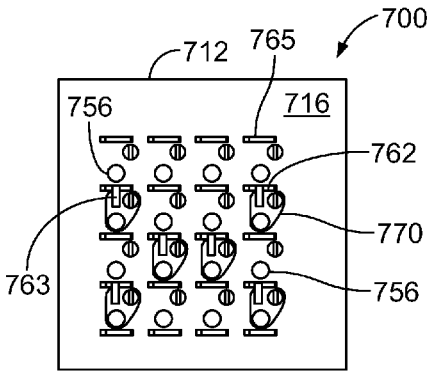
FIG. 14 is a plan view of an underside of the connector assembly of FIG. 12.

The connector assembly 700 also includes a plurality of shield walls 727 that extend along the side surface 714 and separate the contact region 728 into shielded sub-regions 744 (FIG. 13). The shield walls 727 include a conductive material and are electrically coupled to the interposer 710. For example, the shield walls 727 may be electrically coupled to traces or thru-holes in the base substrate 712 or electrically coupled to electrical contacts 756 (FIG. 14). Each shielded sub-region 744 includes one or more of the electrical contacts 720 therein. As shown, the shield walls 727 may extend between adjacent electrical contacts 720 to shield the adjacent electrical contacts 720 from electromagnetic interference.

As shown in FIG. 12, the shield walls 727 include a wall body 752 having a module edge 758 and a component edge 760. The module edge 758 is configured to engage the electronic module, and the component edge 760 is configured to engage the side surface 714. As shown, the module edge 758 includes grounding features 764 formed therealong, and the component edge 760 includes mounting projections 762 projecting therefrom. In an exemplary embodiment, the grounding features 764 extend toward and electrically couple to corresponding electrical contacts 720.

FIG. 14 is a plan view of an underside (or the side surface 716) of the connector assembly 700. In the illustrated embodiment, the mounting projections 762 are configured to be inserted through slots 765 (also shown in FIG. 12) of the base substrate 712. One or more of the mounting projections 762 may be electrically coupled to electrical contacts 756 exposed along the side surface 716. For example, six of sixteen (16) electrical contacts 720 may be coupled to grounding features 764.

In the illustrated embodiment, the electrical contacts 756 are solder ball contacts. The mounting projections 762 may include fingers 763 (also shown in FIG. 12) that extend toward and are mechanically and electrically coupled to corresponding electrical contacts 756 using, for example, a solder paste 770. In other embodiments, the mounting projection 762 does not include a finger. For example, the solder paste 770 could extend to the slot 765 where a portion of the mounting projection 762 is located. As such, the connector assembly 700 is configured to have ground pathways that extend through the shield walls 727 to the interposer 710. More specifically, one ground pathway may extend through one grounding feature 764, the wall body 752, and one mounting projection 762. The ground pathways may be located in a predetermined manner to obtain a desired shielding effect for the connector assembly 700.

Figure 15:
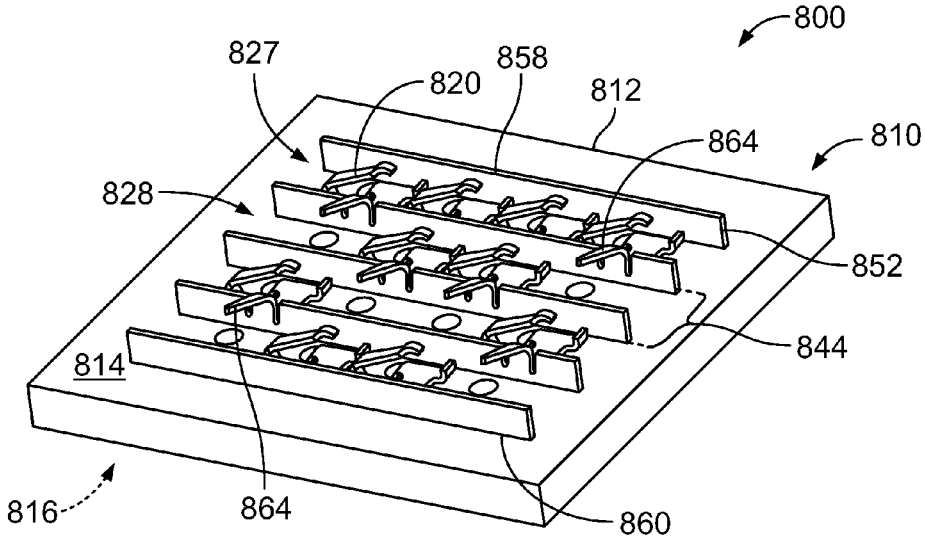
FIG. 15 is a perspective view of an electrical connector assembly formed in accordance with one embodiment.
Figure 16:
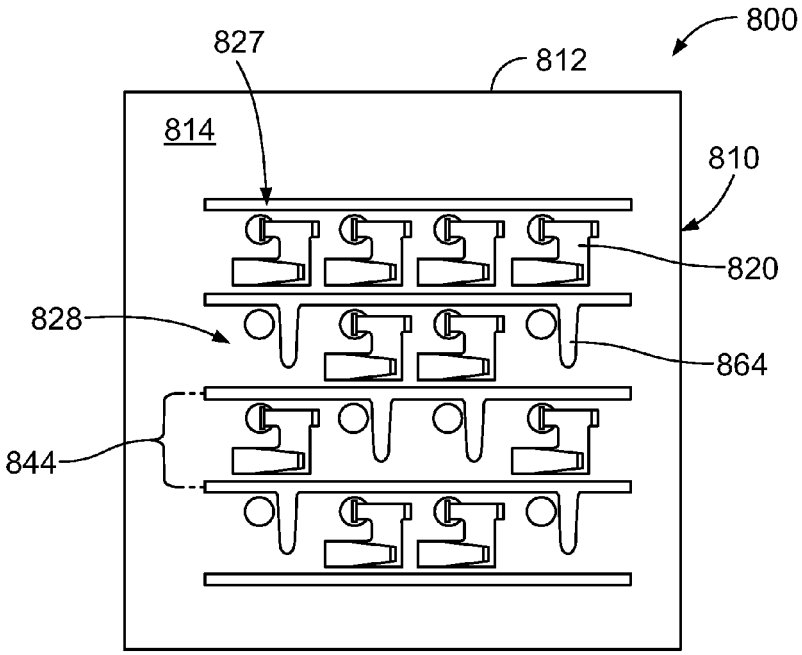
FIG. 16 is a top plan view of the connector assembly of FIG. 15.

FIG. 15 is a perspective view of an electrical connector assembly 800 formed in accordance with one embodiment, and FIG. 16 is a top view of the connector assembly 800. The connector assembly 800 includes an interposer 810 having a base substrate 812 and an array of electrical contacts 820 coupled thereto. The base substrate 812 includes a first side surface 814 and a second side surface 816 (FIG. 15) that face in opposite directions. The electrical contacts 820 are exposed along the side surface 814. Although not shown, the connector assembly 800 may include a socket frame coupled to the interposer. The socket frame may be similar to the socket frames 124, 424 described above. A contact region 828 may exist along the side surface 814. The electrical contacts 820 are located within the contact region 828 and are configured to engage an electronic module (not shown) mounted over the contact region 828. The electronic module may be similar to the electronic module 102 (FIG. 1).

The connector assembly 800 also includes a plurality of shield walls 827 that extend along the side surface 814 and separate the contact region 828 into shielded sub-regions 844. The shield walls 827 include a conductive material and are electrically coupled to the interposer 810. For example, the shield walls 827 may be electrically coupled to traces or thru-holes in the base substrate 812 or directly coupled to electrical contacts (not shown) along the side surface 816 (e.g., solder ball contacts). Each shielded sub-region 844 includes one or more of the electrical contacts 820 therein. As shown, the shield walls 827 may extend between adjacent electrical contacts 820 to shield the adjacent electrical contacts 820 from electromagnetic interference.

As shown in FIG. 15, the shield walls 827 include a wall body 852 having a module edge 858 and a component edge 860. The module edge 858 is configured to engage the electronic module, and the component edge 860 is configured to engage the side surface 814. As shown, the module edge 858 includes grounding features 864 formed therealong. Although not shown, the component edge 860 may include mounting projections projecting therefrom. Such mounting projections may be similar to the mounting projections 762 or 212 described above. In an exemplary embodiment, the grounding features 864 are configured to extend toward and electrically couple to corresponding electrical contacts (not shown) of the electronic module. As shown in FIG. 15, the grounding features 864 may extend away from the side surface 814. For example, the grounding features 864 may extend away from the side surface 814 at an acute angle. In an exemplary embodiment, the grounding features 864 extend over contact holes 865 in which electrical contacts 820 are not positioned. In other words, some of the contact holes 865 have a corresponding electrical contact 820 mechanically and electrically coupled thereto whereas other contact holes 865 do not have an electrical contact 820. The grounding features 864 may extend over the vacant contact holes 865 and engage the electronic module.

As such, the connector assembly 800 is configured to have ground pathways that extend through the shield walls 827 to the interposer 810. More specifically, one ground pathway may extend from the electronic module through one grounding feature 864, the wall body 852, and optionally a mounting projection (not shown). The ground pathways may be located in a predetermined manner to obtain a desired shielding effect for the connector assembly 800.

Figure 17:
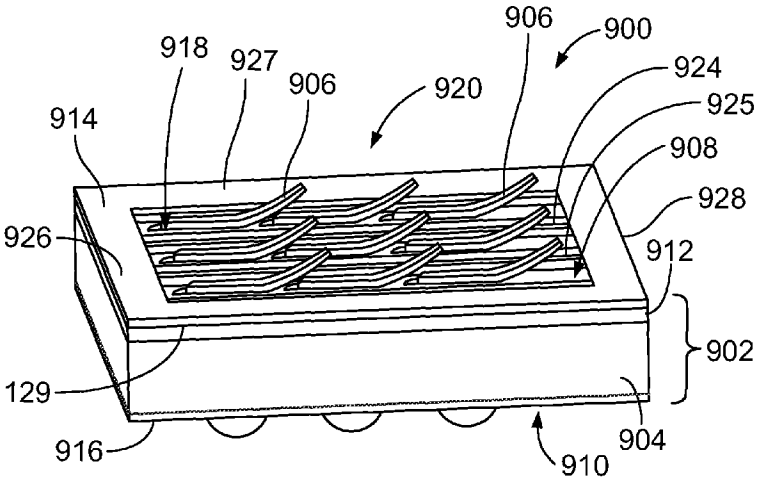
FIG. 17 is a perspective view of a connector assembly formed in accordance with one embodiment.

FIGS. 17-21 illustrate an electrical connector assembly 900 (FIG. 17) formed in accordance with one embodiment. FIG. 17 is a perspective view of the connector assembly 900. The electrical connector assembly 900 may operate in a similar manner as the connector assemblies 106, 306, 406, and 700 described above. For example, the connector assembly 900 is configured to interconnect an electronic module 940 (shown in FIG. 21) and an electrical component (not shown) and is configured to control or reduce electromagnetic interference (EMI) that occurs during operation. To this end, and as will be described in greater detail below, the connector assembly 900 may include a shield wall or a grounding matrix that includes a plurality of shield walls.

As shown, the connector assembly 900 includes an interposer 902. The interposer 902 may have a composite structure that includes a plurality of stacked layers of material. The stacked layers may be similar to those used to manufacture printed circuit boards. For example, the stacked layers may include layers that include a substrate material (e.g., FR-4, polyimide, polyimide glass, metals, and the like); layers that include a bonding material (e.g., acrylic adhesive, modified epoxy, phenolic butyral, pressure-sensitive adhesive (PSA), preimpregnated material, and the like); and layers that include a conductive material, such as copper (or a copper-alloy), cupro-nickel, silver epoxy, and the like. In some cases, layers may include more than one type of material. The interposer 902 may also include various conductive features, such as traces and plated vias (e.g., thru-holes, blind vias, and the like).

In an exemplary embodiment, the interposer 902 has a pair of side surfaces 908, 910 that face in opposite directions. The interposer 902 may include a plurality of stacked layers that include traces and/or plated vias located therein. For example, the interposer 902 may include a board substrate 904. A sheet or layer 912 of conductive material may be bonded to the board substrate 904 and a sheet or layer 914 of resist material (or other non-conductive material) may be bonded along the conductive sheet 912. Another sheet or layer 916 of resist material may be bonded along the side surface 910. The interposer 902 may also include a plurality of electrical contacts 906. The electrical contacts 906 are located within a contact region 920 that extends along the side surface 908. The electrical contacts 906 are exposed to an exterior of the connector assembly 900. Similar to the connector assemblies 106, 306, 406, and 700 described above, the electrical contacts 906 are configured to engage an electronic module that is mounted over the contact region 920.

The connector assembly 900 includes at least one shield wall that is configured to separate adjacent electrical contacts 906 as described above with respect to the other connector assemblies 106, 306, 406, and 700. For example, the connector assembly 900 may include a shielding matrix 918. The shielding matrix 918 may have a plurality of walls 924-929 that are attached to and extend along the side surface 908. The walls 924-929 may be formed from the conductive sheet 912 of conductive material and the non-conductive sheet 914 of resist material. In an exemplary embodiment, the shielding matrix 918 is formed by etching the conductive sheet 912 during manufacture of the connector assembly 900 to form openings along the side surface 908. For instance, the openings may expose portions of the board substrate 904. After the board substrate 904 is exposed, the electrical contacts 906 may be coupled to the interposer 902.

In some embodiments, the conductive sheet 912 may still constitute a single continuous structure along the side surface 908 after etching. In other embodiments, the shielding matrix 918 may include more than one conductive structure along the side surface 908. For example, the conductive sheet 912 may be etched such that the conductive material is separated into two separate structures. Also shown in FIG. 17, the non-conductive sheet 914 of resist material can be etched to include openings. Alternatively, the non-conductive sheet 914 can be deposited onto the conductive sheet 912 after the conductive sheet 912 has been etched.

The walls 924-929 include shield walls 924, 925 and exterior walls 926-929. The shield walls 924, 925 extend along one or more electrical contacts 906 and can separate adjacent electrical contacts 906. In the illustrated embodiment, the connector assembly 900 includes more than one shield wall 924, 925 in which the shield walls 924, 925 extend parallel to each other in the shielding matrix 918. However, in other embodiments, the shield walls 924, 925 may intersect each other at an angle (e.g., 90°). Because the shield walls 924, 925 are etched from the conductive sheet 912, the shield walls 924, 925 may be etched to have various structures or patterns. In alternative embodiments, the connector assembly 900 does not include a shielding matrix 918 of shield walls and, instead, includes only one shield wall 924 or 925.

Figure 18:
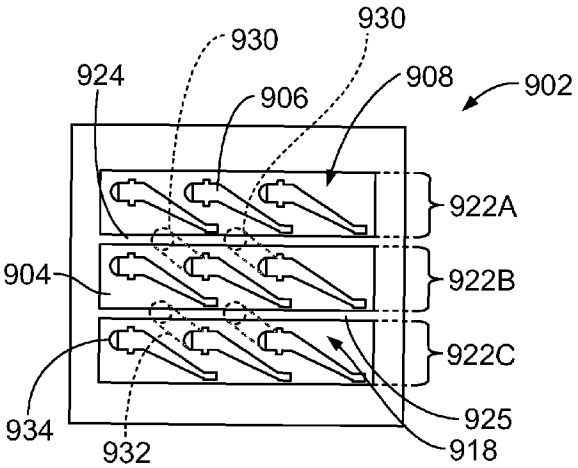
FIG. 18 is a top view of the connector assembly of FIG. 17.

FIG. 18 is a top view of the connector assembly 900. The shield walls 924, 925 extend along the side surface 908 and separate the contact region 920 into shielded sub-regions 922A-C. At least one electrical contact 906 may be located within each shielded sub-region 922A-C. Each electrical contact 906 may be coupled to a corresponding plated via 934 (e.g., thru-hole) thereby electrically connecting the electrical contact 906 to another electrical contact 936 (shown in FIG. 19) along the side surface 910. As shown, the shield walls 924, 925 extend between adjacent electrical contacts 906 to shield the electrical contacts 906 from electromagnetic interference. In the illustrated embodiment, only three shielded sub-regions 922A-C are shown but other embodiments may include more than three shielded sub-regions 922A-C or only two shielded sub-regions 922.

FIG. 18 also shows ground vias 930 (indicated as circular dashed lines) and ground traces 932. The ground traces 932 and the ground vias 930 are electrically connected to the shielding matrix 918. The ground traces 932 electrically connect the ground vias 930 to corresponding electrical contacts 906 and plated vias 934. During manufacture of the interposer 902, the ground vias and traces 930, 932 and the plated vias 934 may be formed in the board substrate 904. In the illustrated embodiment, the ground traces 932 extend along the side surface 908 and are exposed to an exterior, but the ground traces 932 may be located within the board substrate 904 in other embodiments.

In some embodiments, when the conductive sheet 912 (FIG. 17) is deposited onto the board substrate 904, the conductive sheet 912 is coupled to the ground vias 930 in the board substrate 904. The ground traces 932 may be formed from the conductive sheet 912 or may be made from another material. Accordingly, the shield wall 924 is directly coupled to a plurality of ground vias 930, and the shield wall 925 is also directly coupled to a plurality of ground vias 930. In some embodiments, the shield walls 924, 925 can be electrically coupled to one or more of the electrical contacts 906 and the plated vias 934 through the ground traces 932.

Figure 20:
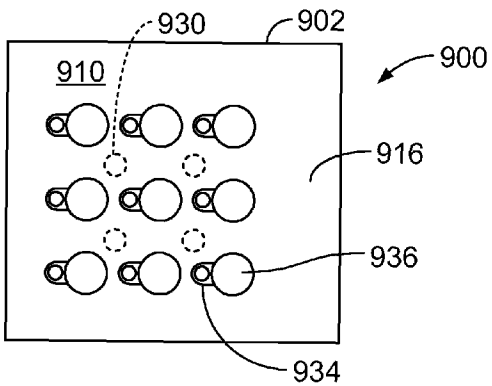
FIG. 20 is a bottom view of the connector assembly of FIG. 17.
Figure 19:
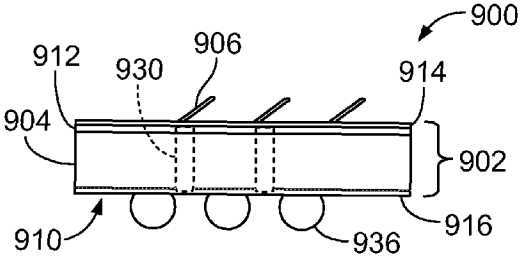
FIG. 19 is a side view of the connector assembly of FIG. 17.

FIG. 19 is a side view of the connector assembly 900, and FIG. 20 is a bottom view of the connector assembly 900. As shown, the ground vias 930 extend through the interposer 902 to the side surface 910 where the non-conductive sheet 916 is located. The side surface 910 includes a plurality of electrical contacts 936. In the illustrated embodiment, the ground vias 930 are not connected to corresponding electrical contacts 936 along the side surface 910 or in the board substrate 904 (FIG. 19). Nonetheless, the ground vias 930 may be positioned in a predetermined manner with respect to the plated vias 934 (FIG. 20). For example, as shown in FIG. 20, the ground vias 930 are positioned in gaps between the plated vias 934. More specifically, each of the ground vias 930 in FIG. 20 is surrounded by four plated vias 934. The ground vias 930 can have various positions with respect to the plated vias 934 that may be determined by the desired electrical performance of the connector assembly 900.

In alternative embodiments, the shield walls 924, 925 (FIG. 17) are not electrically coupled to any of the electrical contacts 906 (FIG. 19). In such alternative embodiments, the shield walls 924, 925 may have features that directly engage the electronic module. For example, portions of the non-conductive sheet 914 (FIG. 19) of resist material may be removed to expose the conductive sheet 912 (FIG. 19) lying underneath. In other words, the shield walls 924, 925 or the exterior walls 926-929 (FIG. 17) may have contact pads that directly engage the electronic module. In these embodiments, the ground vias 930 can be electrically coupled to separate electrical contacts along the side surface 910.

Figure 21:
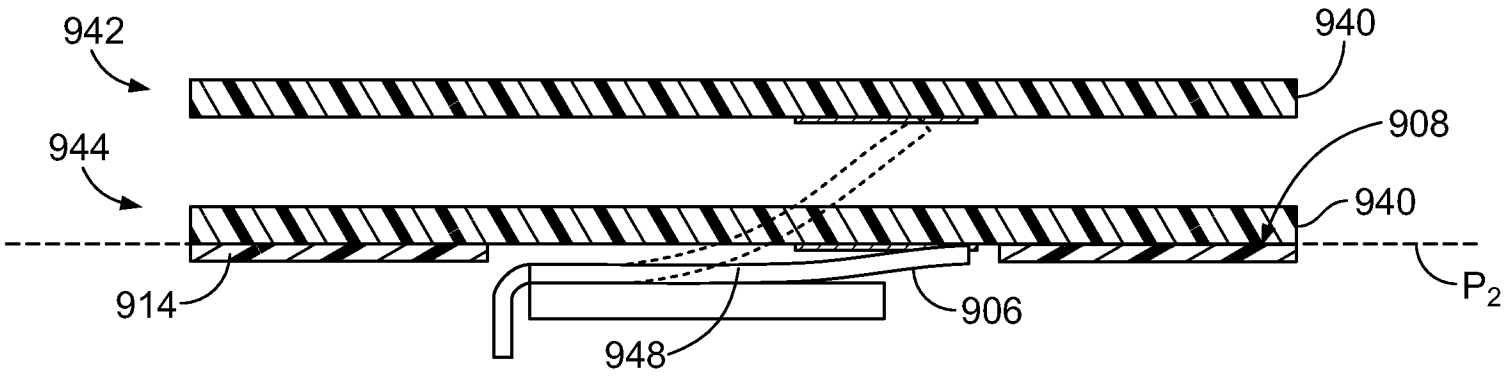
FIG. 21 is a cross-section illustrating the connector assembly of FIG. 17 engaging an electronic module.

FIG. 21 is a cross-section of the interposer 902 (FIG. 17) illustrating the electronic module 940 in an unengaged position 942 (shown in dashed lines), in which the electronic module 940 is spaced apart from the interposer 902, and in a mounted position 944 (solid lines), in which the electronic module 940 is mounted onto and electrically coupled to the interposer 902. In the illustrated embodiment, the electrical contacts 906 include resilient beams 948 that are configured to be deflected toward the side surface 908 by the electronic module 940. The electrical contacts 906 are biased to resist deflection and exert a resistance force in a direction away from the side surface 908.

When the electronic module 940 is in the mounted position 944, the shield walls 924, 925 (FIG. 17) and/or the shielding matrix 918 (FIG. 17) form an interstitial seating plane $P_2$ that is configured to have the electronic module 940 mounted thereon. The seating plane $P_2$ may be similar to the seating plane $P_1$ and may be defined by the non-conductive sheet 914. The seating plane $P_2$ may function as a positive stop that prevents the electrical contacts 906 from being over compressed and/or unevenly compressed. When the electronic module 940 is mounted over the interposer 902, the seating plane $P_2$ prevents further compression of the electrical contacts 906.

Figure 22:
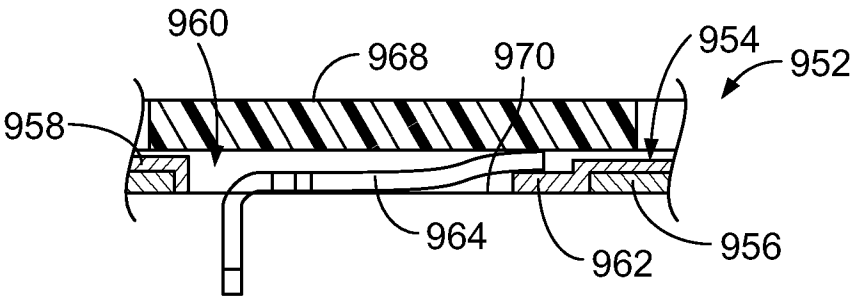
FIG. 22 is a cross-section of a connector assembly formed in accordance with one embodiment.

FIG. 22 is a cross-section of a portion of an interposer 952 that is formed in accordance with another embodiment. As shown, the interposer 952 includes a board substrate 970, a side surface 954, a sheet 956 of conductive material deposited onto the side surface 954, and a sheet 958 of non-conductive material (e.g., resist) that is deposited onto the conductive sheet 956. The conductive sheet 956 is etched as described above to form a shielded sub-region 960. However, after the conductive sheet 956 is etched, the non-conductive sheet 958 is deposited onto the conductive sheet 956. The non-conductive sheet 958 includes a cover extension 962 that clears the conductive sheet 956 at the shielded sub-region 960 and is directly engaged to the board substrate 970. The cover extension 962 may function as a positive stop in the shielded sub-region 960 for an electrical contact 964 when the electronic module 968 deflects the electrical contact 964 toward the board substrate 970. In some embodiments, the electrical contact 964 may clear the non-conductive sheet 958 such that the electrical contact 964 projects beyond the non-conductive sheet 958. In these cases, the electronic module 968 may rest upon the electrical contacts 964 instead of the non-conductive sheet 958.

The embodiments described and/or illustrated herein may provide an electrical connector assembly that has less ground contacts than at least some known connector assemblies for a given-sized connector and/or for an array having a given number of electrical contacts overall. The embodiments described and/or illustrated herein may provide an electrical connector assembly that has more signal contacts than at least some known connector assemblies for a given-sized connector and/or for an array having a given number of electrical contacts overall. The embodiments described and/or illustrated herein may provide an electrical connector assembly that has a higher density of signal contacts than at least some known connector assemblies for a given-sized connector and/or for an array having a given number of electrical contacts overall. The embodiments described and/or illustrated herein may provide electrical connector assembly having a greater flexibility of the relative arrangement of signal contacts, ground contacts, and/or signal contact pairs within an array of electrical contacts than at least some known connector assemblies. The embodiments described and/or illustrated herein may provide an electrical connector assembly wherein a ground contact does not need to be adjacent a signal contact or between two adjacent signal contacts. The embodiments described and/or illustrated herein may provide an electrical connector assembly that is easier to assemble, less expensive to assemble, and/or takes less time to assemble than at least some known connector assemblies.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

an interposer having a side surface and an array of electrical contacts that are exposed to an external space along the side surface, the electrical contacts being configured to engage an electronic module mounted over the side surface; and a shield wall attached to and extending along the side surface, the shield wall having a wall body that extends away from the side surface into the external space along the interposer, the shield wall separating the external space into shielded sub-regions, the shield wall including a conductive material and being electrically coupled to the interposer, wherein at least one electrical contact is located within each shielded sub-region, the shield wall extending between adjacent electrical contacts to shield the adjacent electrical contacts from electromagnetic interference.

2. The electrical connector assembly of claim 1, wherein the shield wall is stamped or etched from conductive material.

3. The electrical connector assembly of claim 2, wherein the shield wall is stamped from a sheet of the conductive material and mechanically coupled to the interposer, the shield wall projecting orthogonal to the side surface.

4. The electrical connector assembly of claim 1, wherein the connector assembly includes a plurality of the shield walls, the plurality of shield walls forming a shielding matrix.

5. The electrical connector assembly of claim 1, wherein at least 75% of the electrical contacts in the array are signal contacts configured to have data signals transmitted therethrough.

6. The electrical connector assembly of claim 1, wherein the shield wall has a module edge that is exposed to the external space and configured to interface with the electronic module, the shield wall including a grounding feature that is located along the module edge, the grounding feature being shaped from the wall body and configured to engage the electronic module, wherein a ground pathway exists through the grounding feature to the interposer.

7. The electrical connector assembly of claim 1, wherein the side surface is a first side surface and the interposer includes a second side surface that faces in an opposite direction than the first side surface, the shield wall having a mounting projection that extends through the interposer and is electrically coupled to an electrical contact that is exposed along the second side surface.

8. The electrical connector assembly of claim 1, wherein the electrical contacts include beams that project away from the side surface into the external space, at least a portion of the beams extending away from the side surface at a non-orthogonal angle.

9. The electrical connector assembly of claim 1, wherein the wall body has opposite sides with a thickness of the wall body extending therebetween, the thickness being substantially uniform, wherein the sides of the wall body are exposed to the external space and define the shielded sub-regions.

10. The electrical connector assembly of claim 1, wherein the interposer has a plurality of stacked layers including a conductive layer that is etched to form the wall body of the shield wall.

11. The electrical connector assembly of claim 1, wherein the shield wall includes a plurality of mounting projections that directly engage the interposer and mechanically couple the interposer and the shield wall.

12. An electrical connector assembly comprising:

an interposer having a side surface and an array of electrical contacts that are exposed to an external space along the side surface, the electrical contacts being configured to engage an electronic module mounted over the side surface; and a shield wall attached to and extending along the side surface, the shield wall having a wall body that extends away from the side surface into the external space along the interposer, the shield wall separating the external space into shielded sub-regions, the shield wall including a conductive material and being electrically coupled to the interposer, wherein at least one electrical contact is located within each shielded sub-region, the shield wall extending between adjacent electrical contacts to shield the adjacent electrical contacts from electromagnetic interference, wherein the interposer includes a board substrate and a layer of conductive material bonded to the board substrate, the shield wall being etched from the layer to expose the side surface and define the wall body.

13. The electrical connector assembly of claim 12, further comprising a plurality of the shield walls, each of the shield walls being etched from the layer.

14. An electrical connector assembly comprising:

an interposer having a side surface and an array of electrical contacts that are exposed to an external space along the side surface, the electrical contacts being configured to engage an electronic module mounted over the side surface; and a shielding matrix including a plurality of shield walls having wall bodies that extend away from the side surface into the external space along the interposer, the wall bodies separating the external space into shielded sub-regions, the shield walls including a conductive material and being electrically coupled to the interposer, wherein at least one electrical contact is located within each shielded sub-region, the shield walls extending between adjacent electrical contacts to shield the respective adjacent electrical contacts from electromagnetic interference.

15. The electrical connector assembly of claim 14, wherein the shield walls are stamped or etched from conductive material.

16. The electrical connector assembly of claim 15, wherein the interposer includes a board substrate and a layer of the conductive material bonded to the board substrate, the shield walls being etched from the layer.

17. The electrical connector assembly of claim 14, wherein the shield walls include a plurality of first shield walls and a plurality of second shield walls, at least some of the first and second shield walls intersecting one another.

18. The electrical connector assembly of claim 14, wherein the shielding matrix forms an interstitial seating plane that is configured to have the electronic module mounted thereon.

19. The electrical connector assembly of claim 14, wherein the shield walls have module edges that are configured to interface with the electronic module and grounding features that are located along the module edge, a ground pathway existing through the grounding feature to the interposer.

20. The electrical connector assembly of claim 14, wherein the side surface is a first side surface and the interposer includes a second side surface that faces in an opposite direction than the first side surface, the shield walls having mounting projections that extend through the interposer and are electrically coupled to corresponding electrical contacts that are exposed along the second side surface.

* * * * *